US010415240B2

(12) United States Patent
Wawi

(10) Patent No.: US 10,415,240 B2
(45) Date of Patent: Sep. 17, 2019

(54) MODULAR PREFABRICATED BUILDING BLOCKS

(71) Applicant: Amgad Wawi, Yorba Linda, CA (US)

(72) Inventor: Amgad Wawi, Yorba Linda, CA (US)

( * ) Notice: Subject to any disclaimer, the term of this patent is extended or adjusted under 35 U.S.C. 154(b) by 0 days.

(21) Appl. No.: 16/111,664

(22) Filed: Aug. 24, 2018

(65) Prior Publication Data

US 2019/0218771 A1 Jul. 18, 2019

Related U.S. Application Data

(60) Provisional application No. 62/709,410, filed on Jan. 18, 2018.

(51) Int. Cl.

| | |
|---|---|
| ***E04B 2/00*** | (2006.01) |
| ***E04B 2/08*** | (2006.01) |
| ***E04B 1/12*** | (2006.01) |
| *E04B 2/02* | (2006.01) |

(52) U.S. Cl.

CPC ..... *E04B 2/08* (2013.01); *E04B 1/12* (2013.01); *E04B 2002/0206* (2013.01); *E04B 2002/0232* (2013.01)

(58) Field of Classification Search

CPC ..... E04B 2/08; E04B 1/12; E04B 2002/0232; E04B 2002/0206

USPC ..... 52/588.1

See application file for complete search history.

(56) References Cited

U.S. PATENT DOCUMENTS 4,060,952 A * 12/1977 Hernandez ..... E04B 2/06 446/125
4,614,071 A * 9/1986 Sams ..... E04C 1/41 52/309.12
5,044,834 A * 9/1991 Janopaul, Jr. ..... E02D 29/0241 405/262
5,163,261 A * 11/1992 O'Neill ..... B28B 7/0079 405/284
5,337,527 A * 8/1994 Wagenaar ..... E02D 29/025 405/284
5,365,714 A * 11/1994 Potvin ..... E04B 2/08 52/590.1
5,623,797 A * 4/1997 Gravier ..... E01F 8/0017 256/19
5,934,037 A * 8/1999 Bundra ..... E04B 2/08 52/126.4
6,134,853 A * 10/2000 Haener ..... E04C 1/41 52/405.2
6,250,986 B1 * 6/2001 Sorensen ..... A63H 33/062 446/121

(Continued)

*Primary Examiner* — Basil S Katcheves
(74) *Attorney, Agent, or Firm* — Cionca IP Law P.C.; Marin Cionca

(57) ABSTRACT

A building block for a modular system for construction of a wall frame, the building block having a frame portion having: a rear exterior side; a front interior side; a top end; a bottom end; a left side; and a right side; a sheathing extending across the rear exterior side; at least a first dowel protrusion or at least a first dowel cutout; at least a first mortise; and at least a first tenon opposite to the at least a first mortise; such that the at a first mortise is capable of associating with a corresponding first tenon of a second building block to create a first mortise and tenon joint; and such that the at least a first tenon is capable of associating with a corresponding first mortise of a third building block to create a second mortise and tenon joint.

17 Claims, 11 Drawing Sheets

(56) References Cited

U.S. PATENT DOCUMENTS

| | | | | |
|---|---|---|---|---|
| D465,816 | S * | 11/2002 | Sorensen | D21/500 |
| 8,297,887 | B2 * | 10/2012 | Ness | B28B 7/0041 405/286 |
| 9,822,529 | B1 * | 11/2017 | Al-Salloum | E04C 1/41 |
| 2005/0108972 | A1 * | 5/2005 | Banova | E04B 2/44 52/596 |
| 2008/0120931 | A1 * | 5/2008 | Joslyn | E04B 2/16 52/293.3 |
| 2010/0180527 | A1 * | 7/2010 | Kim | E04C 1/40 52/309.13 |
| 2014/0109507 | A1 * | 4/2014 | Dossche | B32B 21/04 52/588.1 |
| 2015/0159376 | A1 * | 6/2015 | Biadora | E04C 1/397 52/503 |

* cited by examiner

MODULAR PREFABRICATED BUILDING BLOCKS

CROSS-REFERENCE TO RELATED APPLICATIONS

This application claims the benefit of U.S. Provisional Application No. 62/709,410, filed Jan. 18, 2018, which is hereby incorporated by reference, to the extent that it is not conflicting with the present application.

BACKGROUND OF INVENTION

1. Field of the Invention

The invention relates generally to prefabricated construction and more particularly to modular prefabricated building blocks for construction of walls, building frames, and the like.

2. Description of the Related Art

Current conventional construction methods, such as wooden construction methods for building a frame, can often be inefficient in a number of ways. First, building a wooden frame with sheathing using two-by-four (2 by 4 or two-by-four) studs can be very time consuming. Wooden frames are often assembled on the floor and then raised to the required location by a typical process such as: (1) cutting each 2 by 4 stud to the needed length, (2) spacing them 16 inches (in) apart from the center between a bottom plate and a top plate, (3) securing the studs into place, (4) placing lumber horizontally to support the frame, and (5) raising the frame, which often takes more than two builders. Once the frame is raised, individual sheets of plywood or oriented strand board ("OSB") sheathing are nailed into the frame. This process often takes a long time and requires multiple builders to complete. Additionally, while entire prefabricated walls do exist, they are heavy and require multiple skilled builders to lift and put into place. Currently, there are no prefabricated walls or wall bocks that allow a single person to easily construct a structure.

Wooden construction methods can also be harmful to the environment. The lumber harvested for construction can increase the rate of deforestation, and farming lumber requires large quantities of water and pesticides. Also, wooden construction methods can be expensive due the unpredictable and fluctuating market price of lumber. Thus, there is a need for a solution to these problems.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, a stud block for construction is provided, having the exemplary dimensions of 6 in×32 in and being constructed from recycled plastic. The block may be a rectangular block with an exemplary 1.5 in thickness, and may be provided with the capability to create a mortise and tenon joint with a corresponding building block, wherein the mortise and tenon joint can help the block to maintain its support and structure under great pressure. Along the top of the block there may be provided a length of 1.25 in of a tenon joint to click into other blocks above, plus another tenon joint on the right side of the block which is a 1.25 inch long projecting piece for insertion into another block. In addition, along the bottom and the left side of the block there is a mortise joint, such that each block can connect in alignment with another block. The smaller size of the prefabricated building blocks may make it possible for a user to handle each block and stack them to a desired length and width.

A prefabricated building block can be made in varying forms including: a bottom block, a wall block, a top block, a corner block, and a header block. Any form of a prefabricated building blocks can be manufactured in custom or standard sizes. Particular building blocks or a combination of different building block forms can be used to construct a variety of walls, such as exterior walls, interior walls, load bearing wall, doorways, and so on.

Using modular prefabricated building blocks to build a structure may be advantageous for several reasons. First, each individual block is lightweight, so only one builder is needed. Second, the assembly method is easy to use and only requires a hammer and a ladder, so a person with very little building experience could build a structure. Additionally, building a structure would be much less time consuming, such that the building process can become more time and cost efficient. Thus, an advantage is that the prefabricated building block may provide a user with an easy and efficient system and method for constructing portions of a wall or building frame without the need for assistance from other users or builders, by being able to use a single block at a time and building upon the blocks to create a wall frame of a needed or desired size. Another advantage may be that the tightly cut joints do not break apart when extra weight is applied onto them. Another advantage is that the building blocks may be assembled together in a variety of shapes and sizes, since blocks may be joined together side-by-side, or stacked on top of one or another, in straight or staggered configurations. Another advantage may be that the environmental strain that the lumber industry causes may be alleviated by providing the prefabricated building blocks in alternative materials, such as recycled plastic; additionally, the construction of a building block from plastic or other similar materials may help to prevent damage from mold or termites.

In another aspect, a building block for a modular system for construction of a wall frame is provided, the building block comprising: a frame portion having: a rear exterior side; a front interior side; a top end; a bottom end; a left side; and a right side; a sheathing portion extending across the rear exterior side; at least a first dowel protrusion or at least a first dowel cutout; at least a first mortise; and at least a first tenon opposite to the at least a first mortise; such that the at a first mortise is capable of associating with a corresponding first tenon of a second building block to create a first mortise and tenon joint; and such that the at least a first tenon is capable of associating with a corresponding first mortise of a third building block to create a second mortise and tenon joint. Thus, again, an advantage is that the prefabricated building block may provide a user with an easy and efficient system and method for constructing portions of a wall or building frame without the need for assistance from other users or builders, by being able to use a single block at a time and building upon the blocks to create a wall frame of a needed or desired size. Another advantage may be that the tightly cut joints do not break apart when extra weight is applied onto them. Another advantage is that the building blocks may be assembled together in a variety of shapes and sizes, since blocks may be joined together side-by-side, or stacked on top of one or another, in straight or staggered configurations. Another advantage may be that the environmental strain that the lumber industry causes may be alleviated by providing the prefabricated building blocks in alternative materials, such as recycled plastic; additionally, the construction of a building block from plastic or other similar materials may help to prevent damage from mold or termites.

In another aspect, a building block for a modular system for construction of a wall frame is provided, the building block comprising: a frame portion having: a rear exterior side; a front interior side; a top end; a bottom end; a left side; and a right side; a sheathing portion extending across the rear exterior side; at least a first dowel protrusion; at least a first dowel cutout opposite to the at least a first dowel protrusion; at least a first mortise; at least a first tenon opposite to the at least a first mortise; a first stud extending horizontally from the front interior side on the left side; and a second stud extending horizontally from the front interior side at a center of the frame portion. Thus, again, an advantage is that the prefabricated building block may provide a user with an easy and efficient system and method for constructing portions of a wall or building frame without the need for assistance from other users or builders, by being able to use a single block at a time and building upon the blocks to create a wall frame of a needed or desired size. Another advantage may be that the tightly cut joints do not break apart when extra weight is applied onto them. Another advantage is that the building blocks may be assembled together in a variety of shapes and sizes, since blocks may be joined together side-by-side, or stacked on top of one or another, in straight or staggered configurations. Another advantage may be that the environmental strain that the lumber industry causes may be alleviated by providing the prefabricated building blocks in alternative materials, such as recycled plastic; additionally, the construction of a building block from plastic or other similar materials may help to prevent damage from mold or termites.

In another aspect, a modular system for construction of a wall frame using building blocks is provided, the modular system comprising: a first building block having: a first frame portion having: a first rear exterior side; a first front interior side; a first top end; a first bottom end; a first left side; and a first right side; a first sheathing portion extending across the first rear exterior side; at least a first dowel protrusion on the first top end; at least a first dowel cutout opposite to the at least a first dowel protrusion, and on the first bottom end; at least a first mortise on the first top end; and at least a first tenon opposite to the at least a first mortise, and on the first bottom end; a second building block that combines with the first building block, the second building block having: a second frame portion having: a second rear exterior side; a second front interior side; a second top end; a second bottom end; a second left side; and a second right side; a second sheathing portion extending across the second rear exterior side; at least a second dowel cutout on the second bottom end; at least a second mortise on the second top end; and at least a second tenon opposite to the at least a second mortise, and on the second bottom end; wherein a first dowel-like joint is created by the at least a first dowel protrusion being received by the at least a second dowel cutout; wherein a first mortise and tenon joint is created by the at least a first mortise being received by the at least a second tenon; such that the first building block and the second building block are joined together via the first dowel-like joint and the first mortise and tenon joint. Thus, again, an advantage is that the prefabricated building block may provide a user with an easy and efficient system and method for constructing portions of a wall or building frame without the need for assistance from other users or builders, by being able to use a single block at a time and building upon the blocks to create a wall frame of a needed or desired size. Another advantage may be that the tightly cut joints do not break apart when extra weight is applied onto them. Another advantage is that the building blocks may be assembled together in a variety of shapes and sizes, since blocks may be joined together side-by-side, or stacked on top of one or another, in straight or staggered configurations. Another advantage may be that the environmental strain that the lumber industry causes may be alleviated by providing the prefabricated building blocks in alternative materials, such as recycled plastic; additionally, the construction of a building block from plastic or other similar materials may help to prevent damage from mold or termites.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
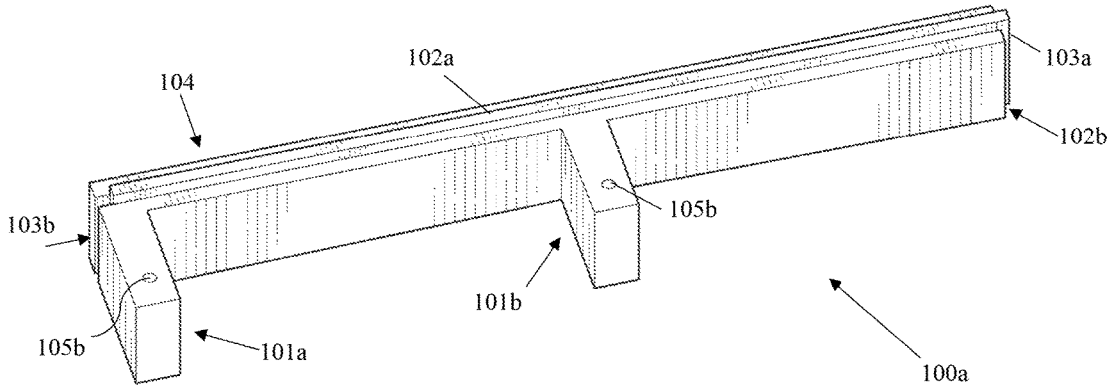
FIG. 1 illustrates a front perspective view of a prefabricated wall building block, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 104 and 204, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 illustrates a front perspective view of a prefabricated wall building block ("prefabricated wall building block," "wall building block," or "wall block") 100*a*, according to an aspect. A prefabricated building block ("prefabricated building block," or "building block") may be provided in a variety of forms or types that may be used for construction of various parts of a building. Examples of the various forms of the prefabricated building block may thus include a wall building block ("wall building block" or "wall block") 100*a*, a bottom building block ("bottom building block" or "bottom block," as shown by 900*b* in FIG. 9), a top building block ("top building block," or "top block," as shown by 1000*c* in FIG. 10), a corner building block ("corner building block," or "corner block," as shown by 1100*d* in FIG. 11), or a header block (as shown by 1300*e* in FIG. 13), as disclosed in greater detail herein. A prefabricated building block may be manufactured by injection molding recycled plastic resin, a plastic resin composite, or another appropriate material, which may be weather-resistant. As will be further discussed hereinafter, prefabricated building blocks may be used to construct a variety of walls, such as exterior walls, interior walls, load bearing walls, doorways, and so on.

Each form of a prefabricated building block may have two main portions: a frame portion ("frame" or "frame portion"), which may be provided in a variety of shapes or sizes according to the particular function of the prefabricated building block, and a sheathing portion ("sheathing" or "sheathing portion"). The frame portion may, for example, be comprised of a body that may be associated with various other components according to the function of the building block, and may be constructed from plastic or recycled plastic. The frame portion may, for example, be associated with a sheathing portion that extends along the rear, exterior side of the frame portion, and be associated with other building block components along the front, interior side, or on the frame top end or bottom end, or any other suitable area of the frame portion. Examples of such building block components may include studs, a header, a corner post, and so on. As examples, in a wall building block, the frame portion may be associated with the studs; for the corner building block, the frame portion may be associated with the studs and the corner post; for a bottom building block, the frame portion may be associated with the studs and the bottom plate.

As disclosed herein, when a plurality of building blocks are assembled, these frame and sheathing portions may serve the same or similar purpose and perform similarly to the building frames and sheathing that are used in conventional construction. As known to those of ordinary skill in the art, a frame with regards to modern construction is commonly made up of a variety of lumber pieces, which is fitted together to form a structure providing support and shape. Sheathing is generally made of rigid panels (typically plywood or oriented strand board "OSB") attached to the exterior of a frame to provide additional strength, stability, and weatherproofing.

As shown in FIG. 1, the sheathing portion of an exemplary prefabricated wall building block 100*a* may be made of sheathing 104, which may extend across the entire back side of a wall building block 100*a*. Prefabricated wall building blocks 100*a* may be secured together with a vertical and a horizontal mortise and tenon joint. These may, for example, be provided as a top tenon 102*a*, a bottom mortise 102*b*, a right tenon 103*a*, and a left mortise 103*b*.

Mortise and tenon joints are known to those of ordinary skill in the art and are formed by inserting a tenon (i.e., a tongue, projection, or protrusion) into a mortise (i.e., a cutout, cavity, or indent). As disclosed in greater detail when referring to FIGS. 5, 7, and 8, the vertical mortise and tenon joint may, for example, be formed by vertical mortises 102*b* and tenons 102*a*, which may be located on the sheathing 104. Similarly, the horizontal mortise and tenon joint may, as an example, be formed by horizontal mortises 103*b* and tenons, which may be located on the sheathing 104. Other suitable types of joints may also be used. The horizontal mortise and tenon may extend substantially across the entire length of the frame portion except in the case where a vertical mortise and tenon are also present, wherein the horizontal mortise extends from the vertical tenon to the opposite side of the frame portion and may extend further out from the frame body such that a horizontal mortise is created.

The frame portion of a prefabricated wall building block 100*a* may be associated with or contain studs 101*a* and 101*b*. The studs 101*a* and 101*b* may be equipped with a dowel-like protrusion ("dowel protrusion," "dowel,") (as shown by 405*a* in FIG. 4) and a dowel-like cut-out ("dowel cut-out") (as shown by 105*b* of FIGS. 1 and 305*b* of FIG. 3), which may form dowel-like joints with corresponding parts of corresponding building blocks, to reinforce and strengthen the vertical and horizontal mortise and tenon joints.

It should be noted that prefabricated building blocks may be manufactured in standard sizes and shapes, or the building blocks may be provided in custom sizes and shapes. As an example, the dimensions disclosed hereinafter for prefabricated building blocks may be describing standard-sized building blocks, wherein the studs 101*a* and 101*b* may be spaced 16 in apart on-center.

Figure 2:
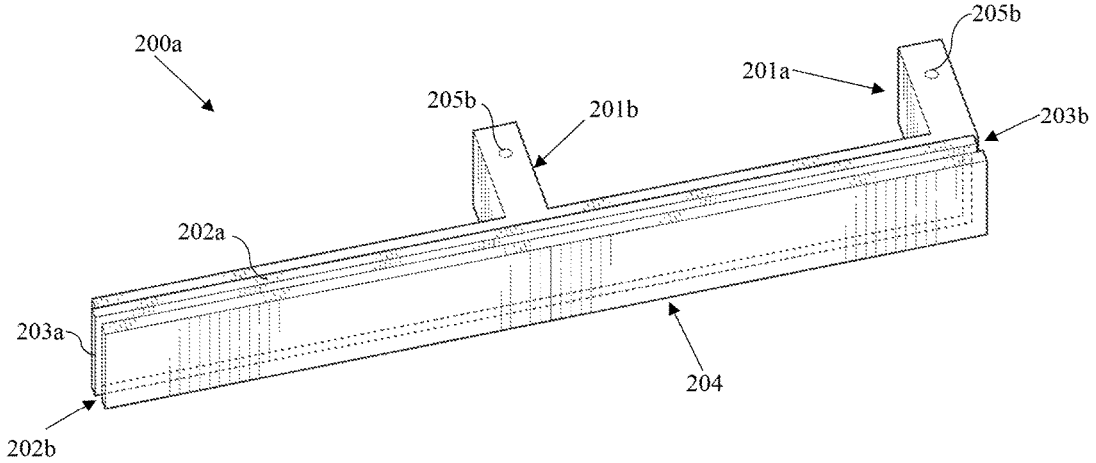
FIG. 2 illustrates a rear perspective view of a prefabricated wall building block, according to an aspect.

FIG. 2 illustrates a rear perspective view of a prefabricated wall building block 200*a*, according to an aspect. As shown, the sheathing 204 may extend over the entire back side of a prefabricated building block, and the sheathing 204 may serve to provide a structure with additional strength and support. The sheathing 204 may also provide a structure with weatherproofing properties. The studs 201*a* and 201*b* having cutouts 205*b* may also be visible in this view.

As shown, the vertical mortise 202*b* and tenon 202*a* may extend across the entire length of the sheathing 204 or body of the frame, and the horizontal mortise 203*b* and tenon 203*a* may extend across the entire height of the sheathing 204 or body of the frame. As a result, when building blocks are assembled, the vertical and horizontal mortise and tenon joints may be strong and unlikely to break apart.

Figure 3:
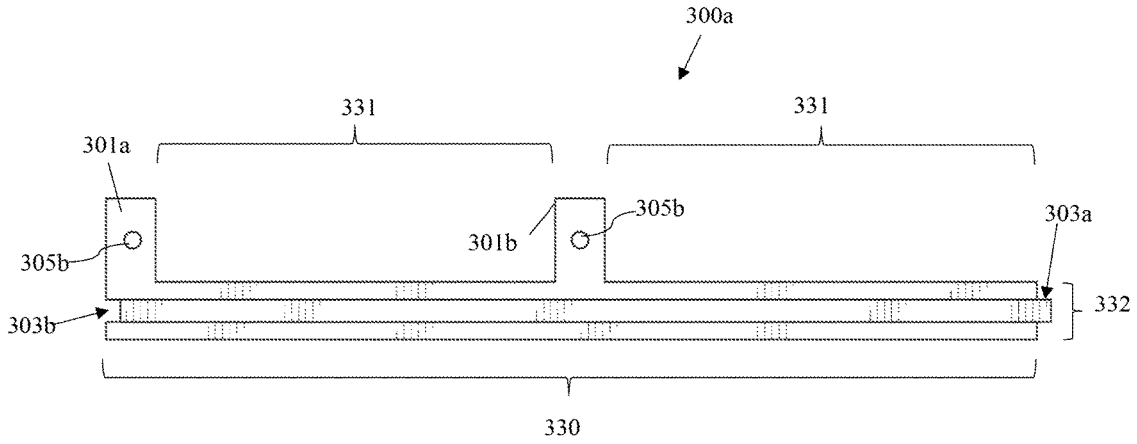
FIG. 3 illustrates a bottom view of the exemplary embodiment of a prefabricated wall building block, according to an aspect.

FIG. 3 illustrates a bottom view of the exemplary embodiment of a prefabricated wall building block 300*a* of FIGS. 1 and 2, according to an aspect. Exemplary standard dimensions disclosed when referring to FIGS. 3-5 and 9-14 may correspond with the actual dimensions of lumber typically used in modern construction. As is known to those of ordinary skill in the art, the actual dimensions of lumber may not equal the dimensions given by a seller, manufacturer, or the like. For example, the actual dimensions of 2 in by 4 in lumber may be approximately 1.5 in by 3.5 in, the actual dimensions of 2 in by 5 in lumber may be approximately 1.5 in by 4.5 in lumber, and the actual dimensions of 4 in by 4 in lumber may be approximately 3.5 in by 3.5 in. Exemplary standard dimensions are as follows.

The prefabricated wall building block 300*a* in FIG. 3 may be a standard-sized building block with the studs 301*a* and 301*b* being spaced 16 in apart, and with the stud 301*b* being approximately at the center of the building block. As disclosed in greater detail when referring to FIG. 5, the width of a stud (such as 301*a*, 301*b*, or 501*a* of FIG. 5) may be 1.5 in. Thus, the actual distance 331 between the studs 301*a* and 301*b* may be approximately 15.25 in and the entire length 330 of the wall building block 300*a* may be approximately 32 in. The thickness 332 of the sheathing (104 of FIG. 1 and 204 of FIG. 2) may be approximately 1.5 in.

It should be noted that the circles representing a dowel protrusion (shown by 405*a* in FIG. 4) and dowel cutout (shown by 105*b* in FIG. 1, 205*b* in FIG. 2, and 305*b* in FIG. 3) may represent an exemplary shape and location for a dowel joint comprising a protrusion or cutout, and may not show the actual dowel protrusion and dowel cutout. It should also be noted that, while the dowel joint may be formed by a circular protrusion 405*a* and cutout 305*b*, other various shapes for a protrusion and cutout may be used, as disclosed when referring to FIG. 5. In other words, a protrusion and cutout may be provided in various shapes, such as a triangle, square, or zigzag (as shown by 505*b* of FIG. 5). Additionally, it should be noted that dowel protrusions and dowel cutouts may have the same or different dimensions. As an example, a circular dowel protrusion 405*a* and a dowel cutout 305*b* may both have a diameter of 0.5 in or may have diameters of 0.5 in and ⅜ in, respectively.

Figure 4:
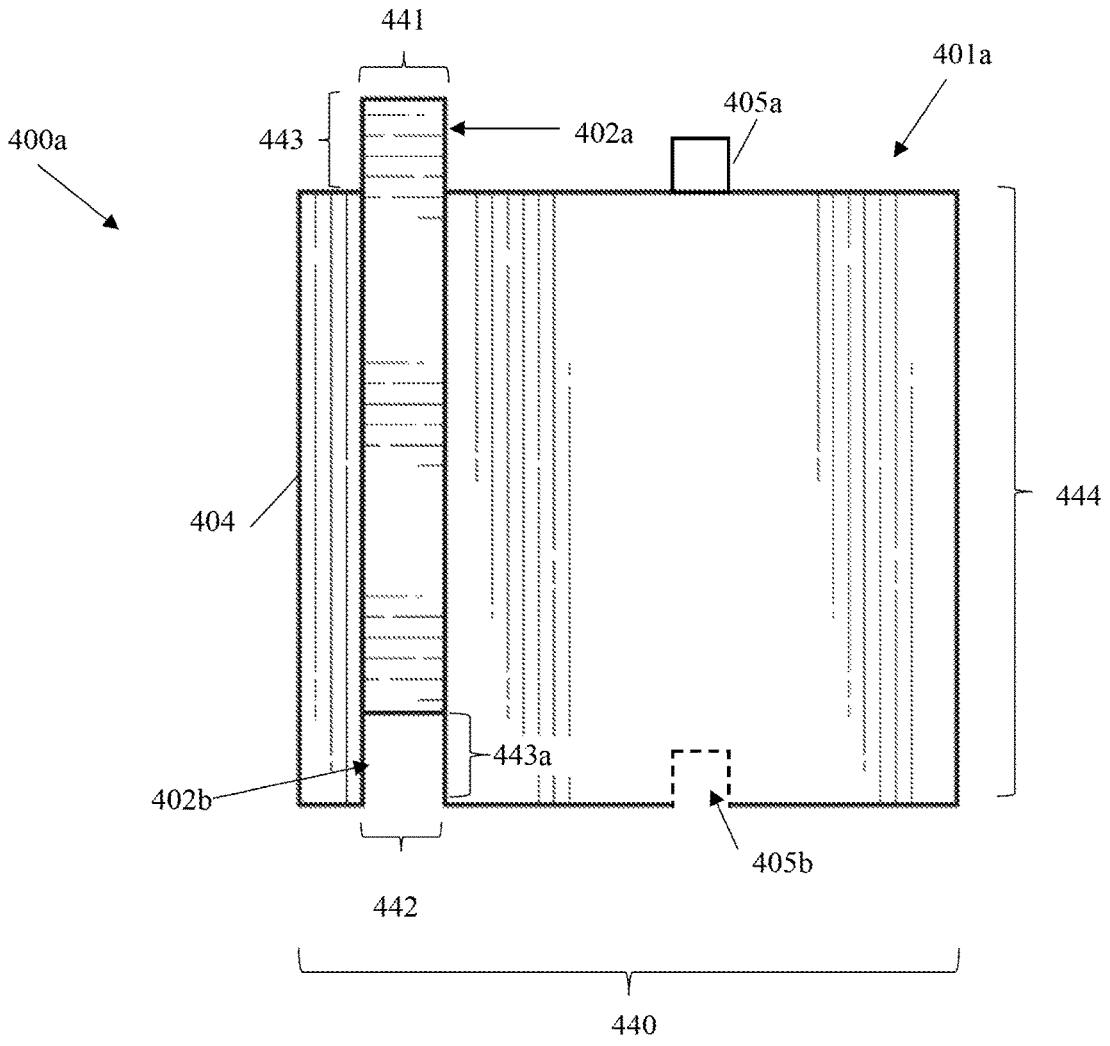
FIG. 4 illustrates the left side elevation view of an exemplary prefabricated wall building block, according to an aspect.

Exemplary standard dimensions of the horizontal mortise 303*b* and tenon 303*a* may be the same as the dimensions of the vertical mortise and tenon (402*b* and 402*a* of FIG. 4) and are disclosed in greater detail when referring to FIG. 4.

FIG. 4 illustrates the left side elevation view of an exemplary prefabricated wall building block 400*a*, according to an aspect. The width 440 of a prefabricated wall building block 400*a*, i.e. the width of the studs together with the sheathing, may be approximately 5 in, wherein the total of 5 inches results from the sheathing being approximately 1.5 in in width, and the stud being approximately 3.5 in in width. The height 444 of a prefabricated building block, i.e. the height of the studs 401*a* together with the sheathing 404, may be 6 in. This height may be advantageous as it may enable builders to more easily construct walls of varying standard and custom heights. One advantage provided by the size is that the building block may be easier for a user to handle without assistance and may be easier to lift than a larger prefabricated wall, or a larger piece of lumber that must be cut to a desired size As disclosed in greater detail when referring to FIG. 16, builders would not have to cut each stud to the required or desired height, and instead simply hammer together the required number of building blocks. As an example, an eight-foot wall may be sixteen building blocks high and a ten-foot wall may be twenty building blocks high.

As represented by 443 in FIG. 4, the height of the vertical tenon 402*a* protrusion and the depth 443*a* of the vertical mortise 402*b* indent may be ⅝ in. The vertical tenon 402*a* may have a width 441 that is slightly larger than the width 442 of the vertical mortise 402*b*, which may be ½ in and ⅜ in, respectively. Similarly, the horizontal tenon and mortise (303*a* and 303*b* of FIG. 3, respectively) may have the same or similar dimensions, with the height of the protrusion and the indent being ⅝ in and the widths being ½ in and ⅜ in, respectively. The widths of the tenons (303*a* and 402*a* of FIGS. 3 and 4, respectively) may be greater than that of the mortises (303*b* and 402*b* of FIGS. 3 and 4, respectively) to create a more snug, tight, and secure joint. It should be noted that the tenons and the mortises may have different dimensions than the exemplary ones given, and may also be provided with unequal dimensions. For example, they may be equal in width (represented by 441 and 442) while the height 443 of the protrusion and the depth 443*a* indent may be 1 in.

The building block 400*a* may also be provided with a dowel protrusion 405*a*, and a dowel cutout 405*b* opposite to the protrusion, such that a corresponding additional building blocks may be associated with the building block 400*a*, by, for example, inserting the protrusion 405*a* into the cutout of another building block from below, or placing the cutout 405*b* onto the protrusion of another building block from above. As another example, the protrusion may be provided on the bottom end, and the cutout may be provided on the top end.

Similarly, the building block 400*a* may be provided with at least a first mortise and a corresponding tenon opposite to the first mortise, such that corresponding additional building blocks may be associated with the building block 400*a* by, for example, inserting the mortise 402*a* into the tenon of another building block from below, or placing the tenon 402*b* onto the mortise of another building block from above. As another example, the mortise may be provided on the bottom end, and the tenon may be provided on the top end.

Similarly, the mortise and tenon may be provided on left and right sides of the building block and may be used to join corresponding building blocks in a side-to-side assembly.

Figure 5:
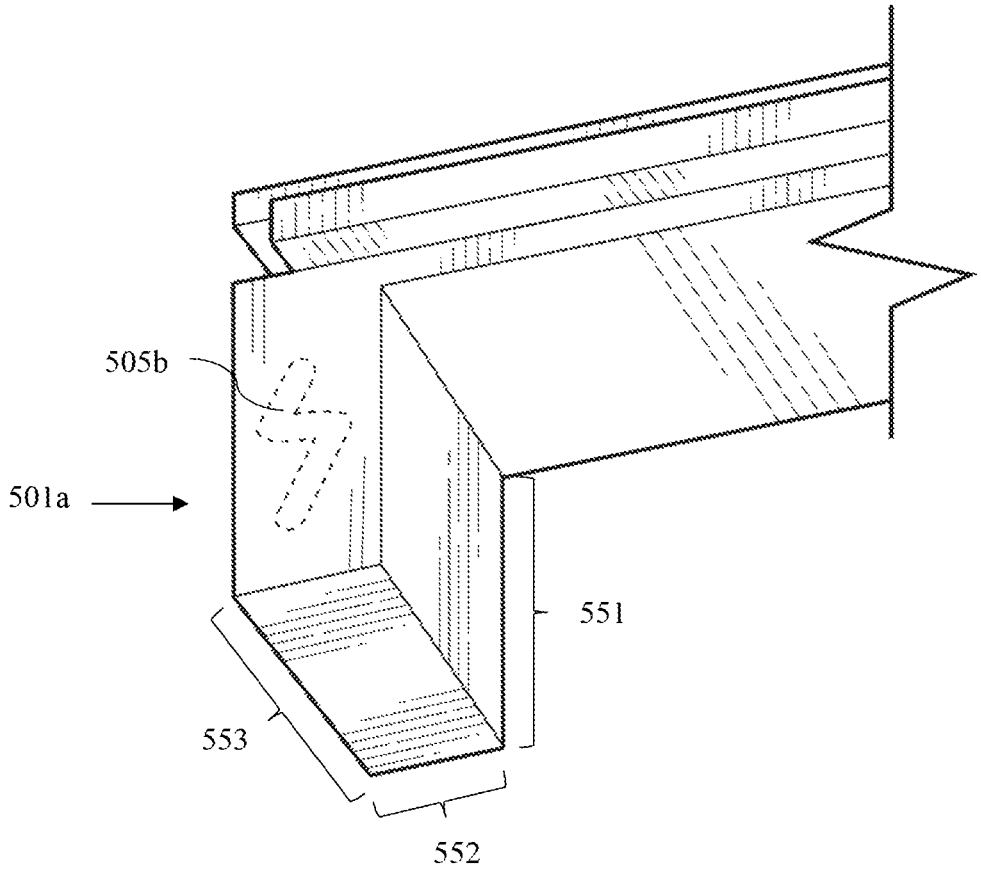
FIG. 5 illustrates the partial top right perspective view of the stud of a prefabricated wall building block, according to an aspect.

FIG. 5 illustrates the partial top right perspective view of the stud 501*a* of a prefabricated wall building block, according to an aspect. As disclosed when referring to FIG. 3, the dowel protrusion (not shown) and dowel cutout 505*b* may be a zigzag shape. A zigzag shape may be advantageous as it may discourage slipping, thus providing additional stabilization when the prefabricated building blocks are in an assembled state or connected with one another.

Exemplary standard dimensions are as follows. A stud 501*a* (also shown by 101*a* of FIG. 1) may have the same actual length and width of 2 in by 4 in lumber, which is typically 1.5 in by 3.5 in, as is known to those of ordinary knowledge in the art. Thus, the length 551 and width 552 of a stud 501*a* may be 3.5 in and 1.5 in, respectively. As disclosed when referring to FIG. 4, the height 553 of a stud 501*a* may be 6 in.

Figure 6:
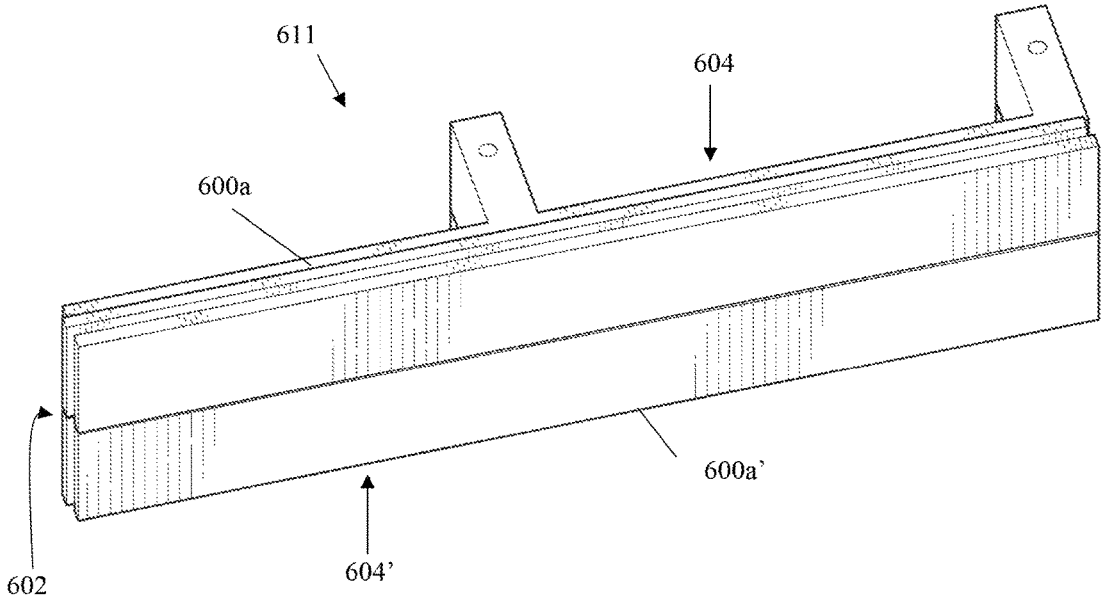
FIG. 6 illustrates a rear perspective view of a prefabricated wall building block assembly, according to an aspect.

FIG. 6 illustrates a rear perspective view of a prefabricated wall building block assembly 611, according to an aspect. Two prefabricated wall building blocks 600*a* and 600*a*' may be used to create the assembly 611, and are shown associated together in an exemplary assembled state. The building blocks 600*a* and 600*a*' may be similar to the building block described hereinbefore when referring to FIGS. 1 though 5. Prefabricated wall building blocks, such as 600*a* and 600*a*', may be assembled by stacking like portions (i.e., frame portions with frame portions, or studs with studs, and sheathing portions with sheathing portions) vertically and next hammering the vertical tenon and mortise (such as 102*a* and 102*b* of FIG. 1, respectively) parts together to form a vertical mortise and tenon joint 602. In other words, the sheathing portion 604 of wall building block 600*a* may be placed directly above the sheathing portion 604' of wall building block 600*a*' and the stud portions of building block 600*a* may be placed directly above the stud portions of building block 600*a*'. Thus, the dowel protrusions and dowel cutouts (405*a* and 305*b* of FIGS. 4 and 3, respectively) and the vertical mortise and tenon (102*b* and 102*a* of FIG. 1, respectively) may align to form a dowel joint and a mortise and tenon joint 602, respectively. The assembly arrangement is also disclosed in greater detail when referring to FIGS. 7 and 8.

Figure 16:
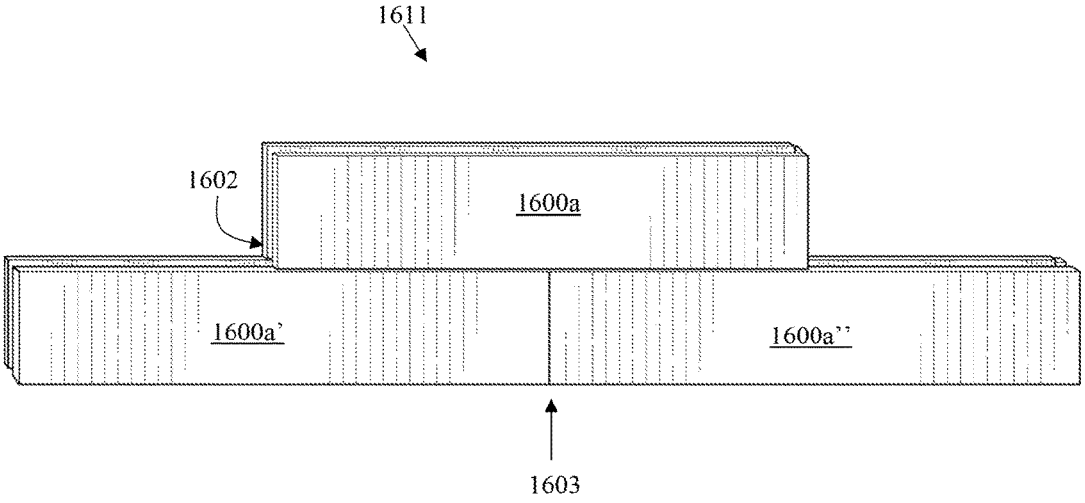
FIG. 16 illustrates a rear elevation view of another exemplary prefabricated building block assembly, according to an aspect.

It should be noted that assembling prefabricated building blocks horizontally may be performed in a similar manner by placing two building blocks side by side or in parallel with each other, and hammering the horizontal mortise and tenon (such as 103*b* and 103*a* of FIG. 1, respectively) of the building blocks together to form a horizontal mortise and tenon joint, as disclosed in greater detail when referring to FIG. 16. It should also be noted that prefabricated building blocks may be assembled in alternating arrangements to that disclosed in FIGS. 6 and 7. As an example, prefabricated building blocks may be assembled in a staggered arrangement (similar to the arrangement use for brick walls), as disclosed in greater detail when referring to FIG. 16.

Figure 7:
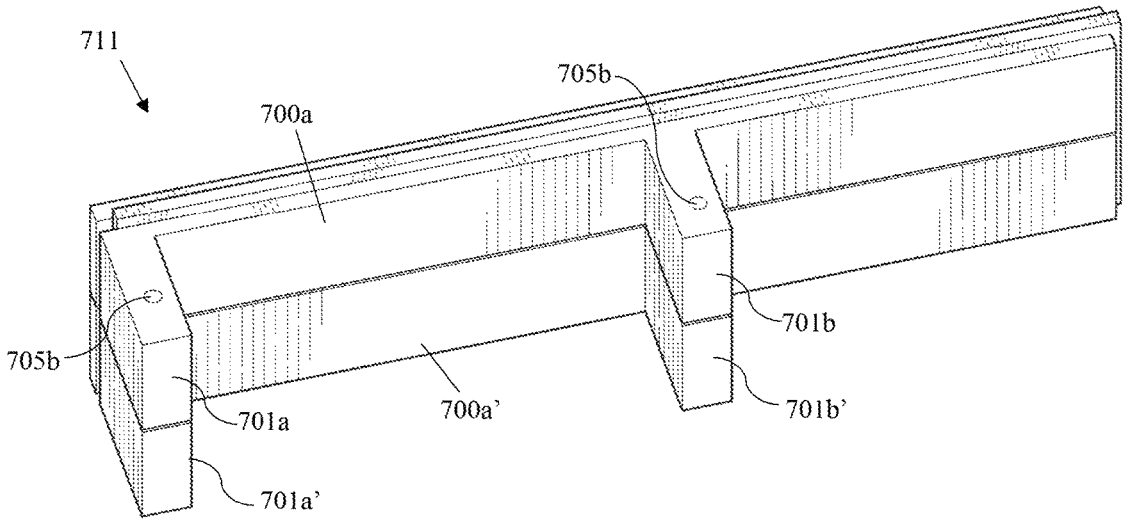
FIG. 7 illustrates a front perspective view of an exemplary prefabricated wall building block assembly, according to an aspect.

FIG. 7 illustrates a front perspective view of an exemplary prefabricated wall building block assembly 711, according to an aspect. As disclosed when referring to FIG. 6, prefabricated wall building blocks (such as 700*a* and 700') may be assembled vertically by stacking or aligning like portions together. As shown in FIG. 7, the stud portions of each building block may be stacked directly above one another (i.e., 701*a* and 701*b* are place directly above 701*a*' and 701*b*', respectively), such that the dowel cutouts 705*b* and dowel protrusions (not shown) may be associated in order to form dowel joints.

It should be noted that additional building blocks (not shown) may be added to the assembly 711. As an example, additional building blocks may be added vertically by placing the dowel cutouts (such as 305*b* in FIG. 3) of a building block directly on top of the dowel protrusions (not shown), and hammering the new building block down and into place, thus forming a new dowel joint and a new vertical mortise and tenon joint. As another example, additional prefabricated building blocks may be added to the assembly 711 horizontally by using the method described hereinbefore when referring to FIG. 6.

Figure 8:
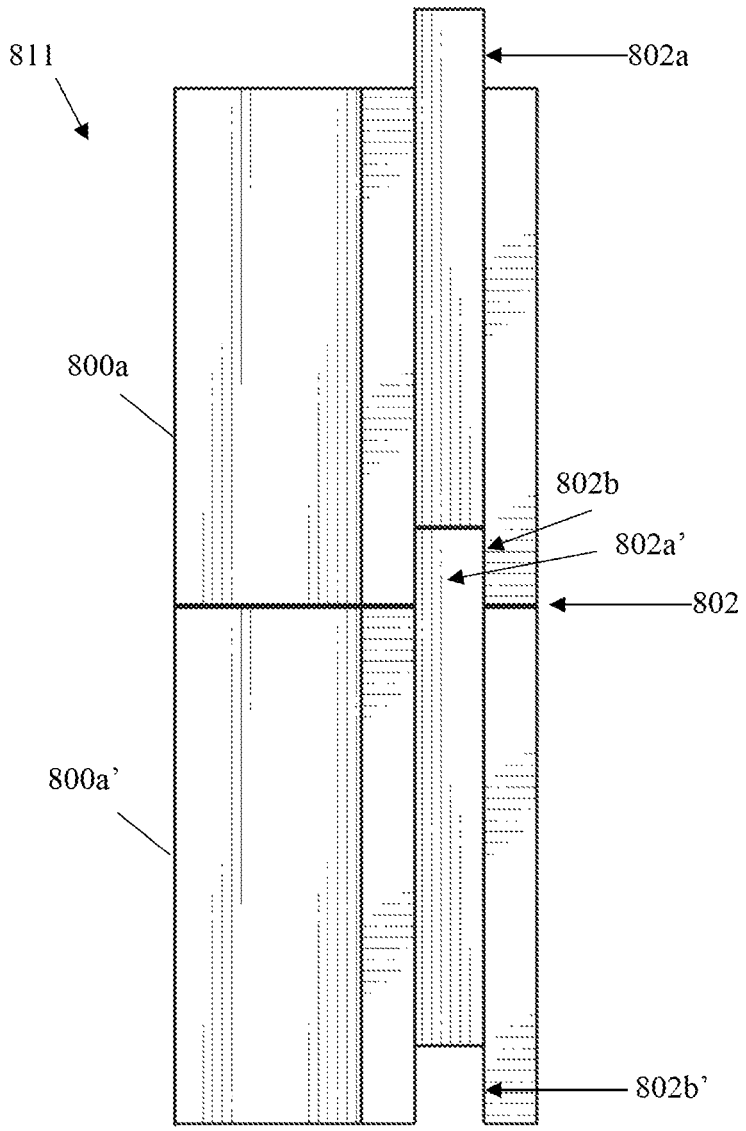
FIG. 8 illustrates a right side elevation view of an exemplary prefabricated wall building block assembly, according to an aspect.

FIG. 8 illustrates a right side elevation view of an exemplary prefabricated wall building block assembly 811, according to an aspect. As disclosed hereinbefore when referring to FIGS. 6 and 7, two prefabricated wall building blocks (such as 800*a* and 800*a*') may be assembled vertically by stacking like portions on top of one another. The mortise portion 802*b*, which may appear as an indent, of the wall building block 800*a* may be placed directly on top of the tenon portion 802*a*', which may appear as a protrusion, of wall building block 800*a*' to form a vertical mortise and tenon joint 802. As disclosed when referring to FIG. 4, the width of the tenon may be greater than that of the mortise, such that the joint 802 may be snug and stable. A horizontal mortise and tenon joint may, for example, appear similarly to the vertical mortise and tenon joint 802. For visual clarity of the assembly 811, the dowel protrusions and cutouts are not shown in this view, but the building blocks 800*a* and 800*a*' may also be provided with dowel protrusions and cutouts, and may be similar to the dowel protrusion and cutout shown in FIG. 4.

Figure 9:
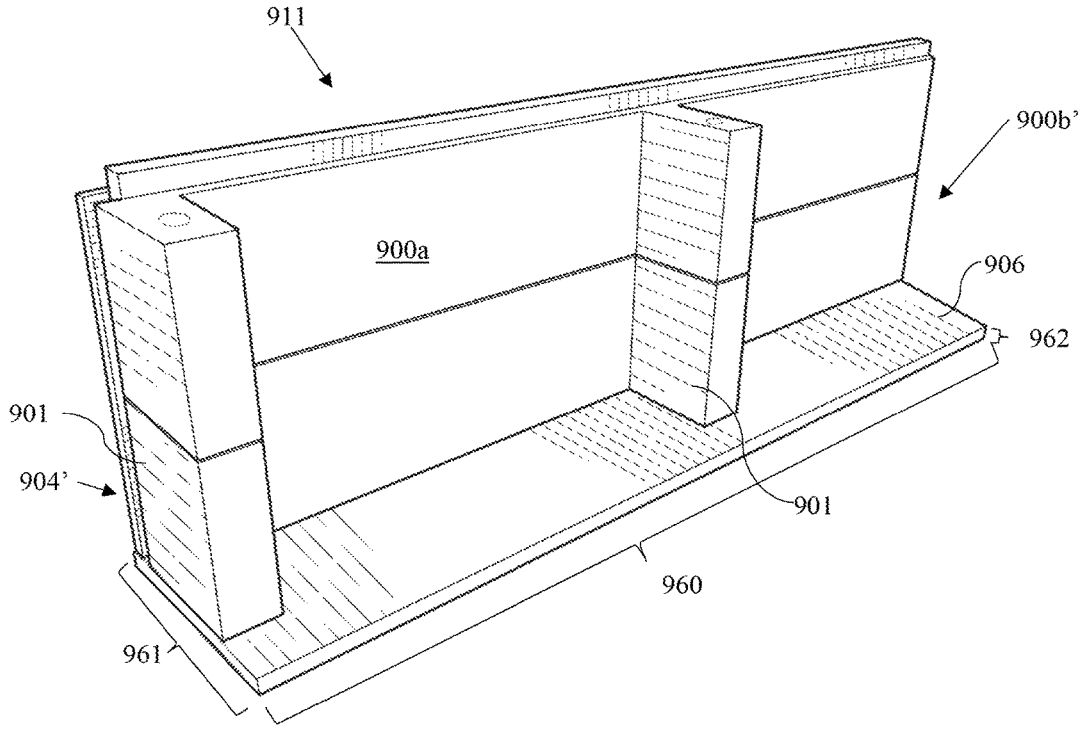
FIG. 9 illustrates a front perspective view of an exemplary prefabricated building block assembly containing a wall building block and a prefabricated bottom building block, according to an aspect.

FIG. 9 illustrates a front perspective view of an exemplary prefabricated building block assembly 911 containing a wall building block 900*a* and a prefabricated bottom building block 900*b*', according to an aspect. The building blocks 900*a* and 900*b*' are shown assembled in a similar manner to that described hereinbefore when referring to FIGS. 6, 7, and 8, but it should be noted that the building blocks 900*a* and 900*b*' may be assembled in another appropriate configuration (such as in a staggered configuration).

As shown in FIG. 9, the wall building block 900*a* may be the building block disclosed hereinbefore when referring to FIGS. 1 though 5. The bottom building block 900*b*' may be similar to the wall building block 900*a*, wherein the prefabricated bottom building block 900*b*' may have two main portions: a frame portion and a sheathing portion. In a bottom building block 900*b*' the sheathing portion 904' may be the same as the sheathing portion 904 of the wall building block 900*a* and thus also cover the entire exterior side of the building block and may have the dimensions 32 in by 1.5 in by 6 in (represented by 330, 332, and 444 of FIGS. 3 and 4, respectively).

Like the frame portion of a prefabricated wall building block 900*a*, the frame portion of a prefabricated bottom building block 900*b*' may also contain studs 901. The dimensions of the studs 901 may be the same as the dimensions of the studs of the wall building block disclosed when referring to FIG. 5 (i.e., 3.5 in by 1.5 in by 6 in, and referred to by 551, 552, and 553, respectively). Unlike the frame portion of a wall building block 900*a*, the frame portion of a bottom building block 900*b*' may be provided with a bottom plate 906. The dimensions of a bottom plate 906 may correspond to the actual dimensions of 2 in by 5 in lumber provided with sheathing 904' attached. As is known to those of ordinary skill in the art, the actual dimensions of 2 in by 5 in lumber may be approximately 1.5 in by 4.5 in. Thus, the dimensions of a bottom plate 906 may also be approximately 6 in by 32 in by 1.5 in (represented by 961, 960, and 962, respectively), wherein the total of approximately 6 in is a result of the sheathing being approximately 1.5 in by 4.5 in from the lumber dimensions.

It should be noted that, while the bottom building block 900*b*' may have dowel protrusions (such as 405*a* of FIG. 4), it may not have dowel cutouts (such as 305*b* of FIG. 3). Similarly, while the bottom building block 900*b*' may have a vertical tenon (such as 102*a* of FIG. 3), it may not have a vertical mortise (such as 102*b* of FIG. 1). The bottom building block 900*b*' may be constructed such that the bottom plate 906 is flush with the studs and frame body, as shown as an example.

Figure 10:
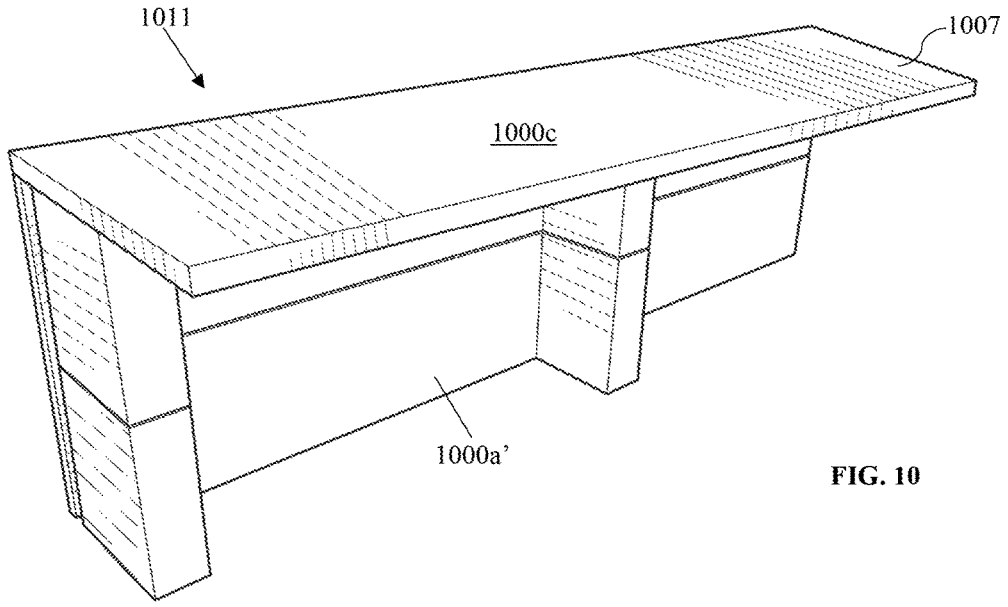
FIG. 10 illustrates a front perspective view of an exemplary prefabricated building block assembly containing a wall building block and a prefabricated top building block, according to an aspect.

FIG. 10 illustrates a front perspective view of an exemplary prefabricated building block assembly 1011 containing a wall building block 1000*a* and a prefabricated top building block 1000*c*', according to an aspect. The building blocks 1000*a* and 1000*c*' are shown assembled in a similar manner to that described hereinbefore when referring to FIGS. 6, 7, and 8, but it should be noted that the building blocks 1000*a* and 1000*c*' may be assembled in another appropriate configuration (such as in a staggered configuration).

As shown in FIG. 10, the wall building block 1000*a* may be the building block disclosed hereinbefore when referring to FIGS. 1 though 5. Similar to the bottom building block disclosed when referring to FIG. 9, the top building block 1000*c*' may have two main portions: a frame portion and a sheathing portion. In a top building block 1000*c*' the sheathing portion 1004' may be the same as the sheathing portion 1004 of the wall building block 1000*a*. In other words, the sheathing portion 1004' may also cover the entire exterior side of the building block and may have the dimensions 32 in by 1.5 in by 6 in (represented by 330, 332, and 444 of FIGS. 3 and 4, respectively).

As shown by FIG. 10, the frame portion of a prefabricated top building block 1000*c*' may contain the studs 1001' and the top plate 1007. The dimensions of the studs 1001' may be the same as the dimensions of the studs of the wall building block disclosed when referring to FIG. 5 (i.e., 3.5 in by 1.5 in by 6 in referred to by 551, 552, and 553, respectively). As an example, the dimensions of a top plate 1007 may be the same as the dimensions of a bottom plate (906 of FIG. 9). In other words, the dimensions of a top plate 1007 may be 6 in by 32 in by 1.5 in (corresponding to 961, 960, and 962 of FIG. 9, respectively, wherein the total of approximately 6 in results from the sheathing being approximately 1.5 in by 4.5 in from the lumber dimensions.

It should be noted that, while the top building block 1000*b*' may have dowel cutouts (such as 305*b* of FIG. 3), it may not have dowel protrusions (such as 405*a* of FIG. 4). Similarly, while the top building block 1000*b*' may have a vertical mortise (such as 102*b* of FIG. 1), it may not have a vertical tenon (such as 102*a* of FIG. 3). Again, similar to the bottom building block 900*b*', the top building block 1000*c*' may be constructed such that the top plate 1007 is flush with the studs and frame body, as shown as an example.

Figure 11:
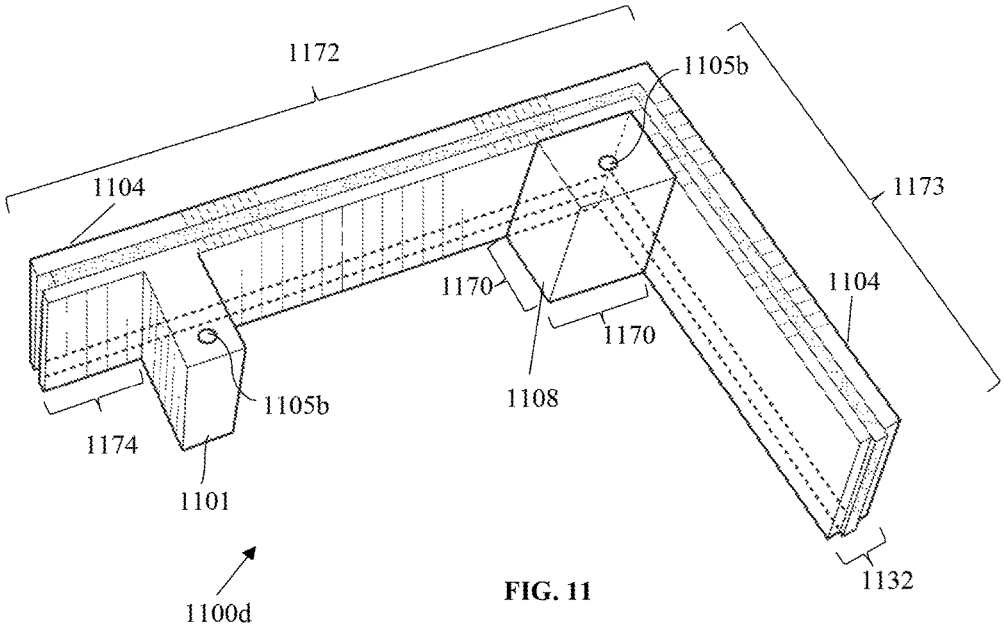
FIG. 11 illustrates a front, top perspective view of an exemplary prefabricated corner building block with a stud and a corner post, according to an aspect.

FIG. 11 illustrates a front, top perspective view of an exemplary prefabricated corner building block 1100*d* with a stud 1101 and a corner post 1108, according to an aspect. The corner building block 1100*d* may turn at the corner post 1108 and may be used to construct the corners of rooms, walls, and the like. On a standard-sized corner building block 1100*d*, the angle of the turn may be 90 degrees, for example. However, it should be noted that the angle of the turn may be different for other standard or custom-sized building blocks.

Similar to the prefabricated building blocks described hereinbefore, a corner building block 1100*d* may have two main portions: a frame portion and a sheathing 1104 portion. The sheathing 1104 of the corner building block 1100*d* may be similar to the sheathing (104 of FIG. 1 and 204 of FIG. 2) of the wall building block (100*a* of FIGS. 1 and 200*a* of FIG. 2) and have the same dimensions, and may extend across the exterior side or sides of the corner building block 1100*d*.

As shown by FIG. 11, the frame portion of a prefabricated corner building block 1100*d* may contain a stud 1101 and a corner post 1108. As an example of a standard size corner building block 1100*d*, the stud 1101 and corner post 1108 may be spaced 16 in apart. Exemplary dimensions are as follows. The stud 1101 may have the same dimensions as the studs of a wall building block (i.e., 1.5 in by 3.5 in represented by 552 and 551 of FIG. 5, respectively) and the corner post 1108 may have the actual dimensions of 4 in by 4 in lumber (i.e., 3.5 in by 3.5 in represented by 1170). Thus, the distance between the stud 1101 and the corner post 1108 may be 13.5 in. The corner post 1108 may be 3.5 in in length, and the distance between the corner post and stud 13.5 in and thus the length represented by 1173 may be approximately 17 in. The lengths represented by 1172, and 1174 may be of any suitable length for constructing the corner block.

Similar to the studs (such as 101 and 1101 of FIGS. 1 and 11, respectively) a corner post 1108 may have a dowel-like cutout 1105*b* and a dowel like protrusion (not shown). Additionally, a corner building block 1100*d* may be modified to also have a top plate (906 of FIG. 9) or a bottom plate (1007 of FIG. 10).

Figure 12:
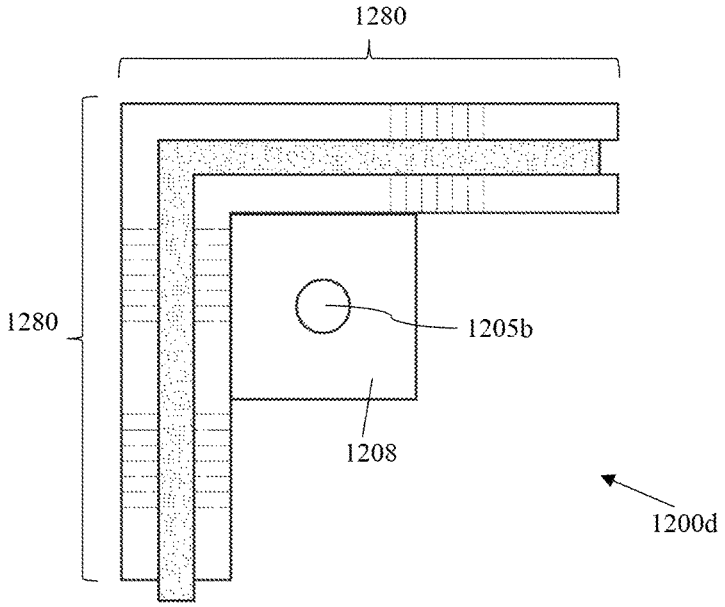
FIG. 12 illustrates a bottom view of an exemplary prefabricated corner building block with a corner post and having no studs, according to an aspect.

FIG. 12 illustrates a bottom view of an exemplary prefabricated corner building block 1200*d* with a corner post 1208 and having no studs, according to an aspect. Similar to the corner building block 1200*d* disclosed hereinbefore when referring to FIG. 11, there may be a 90 degree turn at the corner post 1208. The corner post 1208 of this embodiment may also have the same dimensions of the corner post 1108 disclosed hereinbefore when referring to FIG. 11. A dowel cutout 1205*b* may be provided, or a dowel protrusion (as shown as an example in FIG. 4).

It should be noted that prefabricated corner building blocks (1100*d* and 1200*d* of FIGS. 11 and 12, respectively) with a bottom plate (906 of FIG. 9) or a top plate (1007 of FIG. 10) can also be manufactured. The lengths represented by 1280 may, for example, be equal lengths, and may be for example 10.5 in or any other suitable length. The corner blocks may also be provided in a variety of sizes such that a smaller block may be stacked on top of a larger block, or vice versa.

Figure 13:
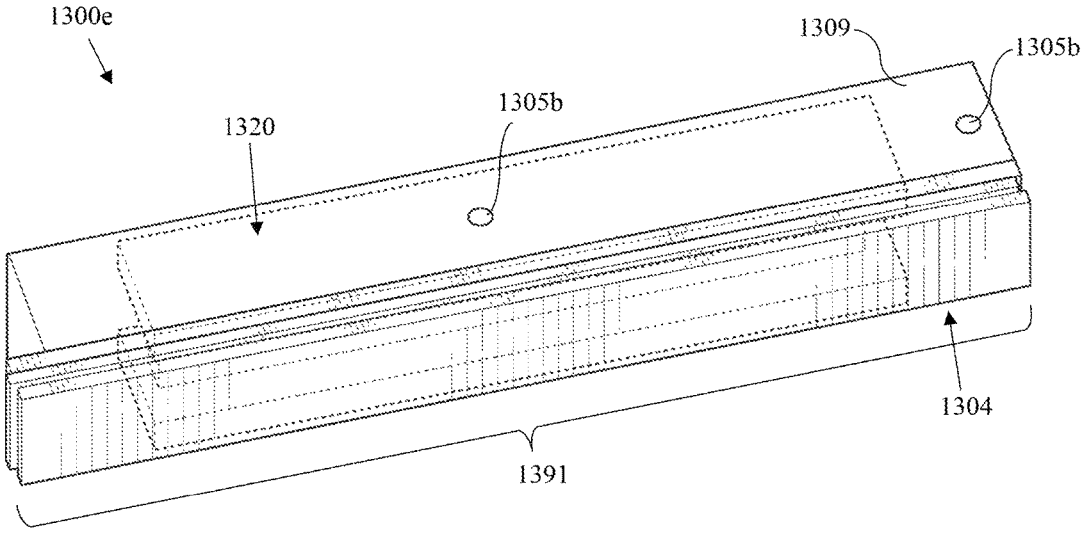
FIG. 13 illustrates a rear perspective view of a prefabricated header building block, according to an aspect.

FIG. 13 illustrates a rear perspective view of a prefabricated header building block 1300*e*, according to an aspect. As is known to those of ordinary skill in the art, beam-like supports or headers may be used in conventional construction at the top of openings, such as windows of a wall, to transfer weight to the trim and then to the foundation. Thus, a prefabricated building block with a header may be advantageous. As is known to those of ordinary skill in the art, the support and strength required for a header 1309 to provide may depend on a number of factors, such as the opening width, building width, the weight of floors, ceilings, and roofs above the opening, and so on. Thus, the dimensions of a header 1309 may vary depending on the opening and it may be particularly advantageous to have custom sized header building blocks 1300*e* to meet the specific needs of a user or of a particular construction project.

Similar to the building blocks described hereinbefore, a header building block 1300*e* may have two main portions: a frame portion and a sheathing portion. The sheathing 1304 portion may be similar to the sheathing portions of a wall, bottom, top, and corner building block sheathing portions and have the same dimensions. The header may be shorter than the length of the sheathing and frame body represented by 1391, as shown as an example in FIG. 13, or the header may also be flush with the sheathing on both edges, as another example, or longer than the sheathing, as another example.

The frame portion of a prefabricated header building block 1300*e* may contain a header 1309 with an internal support beam ("internal support beam," or "internal beam") 1320 represented by a dashed line. The header 1309 may have dowel cutouts 1305*b* on top and dowel protrusions (not shown) on bottom or vice versa at 16 in (on-center) intervals such that they align with and fit into the dowel protrusions (such as 405*a* of FIG. 4) and cutouts (such as 305*b* of FIG. 3) located on the struts (such as 301*a* and 301*b* of FIG. 3) of a wall building block.

Figure 14:
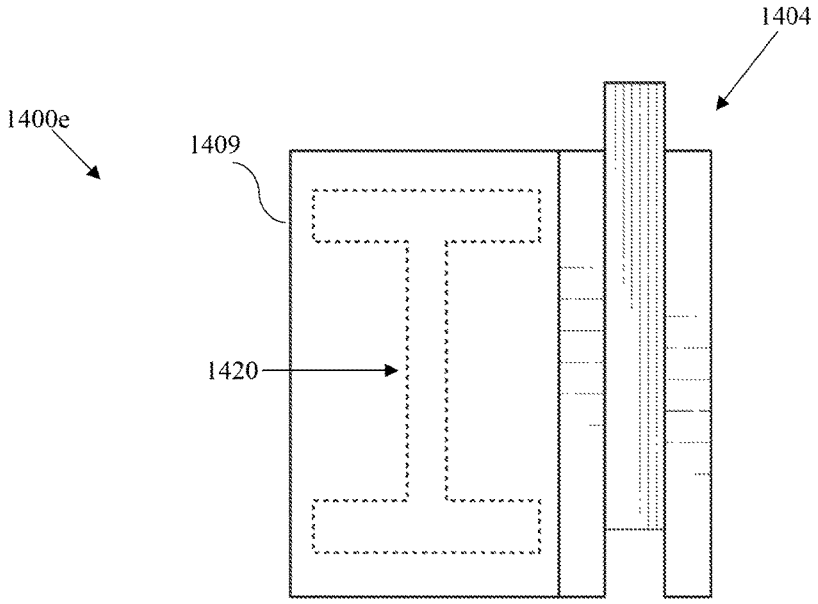
FIG. 14 illustrates a left side elevation view of an exemplary prefabricated header building block with a header, according to an aspect.

FIG. 14 illustrates a left side elevation view of an exemplary prefabricated header building block 1400*e* with a header 1409, according to an aspect. The exterior side of the building block may be provided with sheathing 1404. As shown in FIG. 14, the internal beam 1420 may be central to or contained within the header 1409. For visual clarity of the header 1409, the dowel protrusions and cutouts are not shown in this view, but the header building block 1400*e* may also be provided with dowel protrusions and cutouts, which may be similar to the dowel protrusions and cutouts shown as examples in FIG. 4.

The internal beam 1420 may reinforce and provide support at the opening of a structure, such as a door or window. Thus, any appropriate material and material shape may be used to manufacture the internal support beam 1420. As an example, a support beam may be a solid wood block or a steel I-beam.

Figure 15:
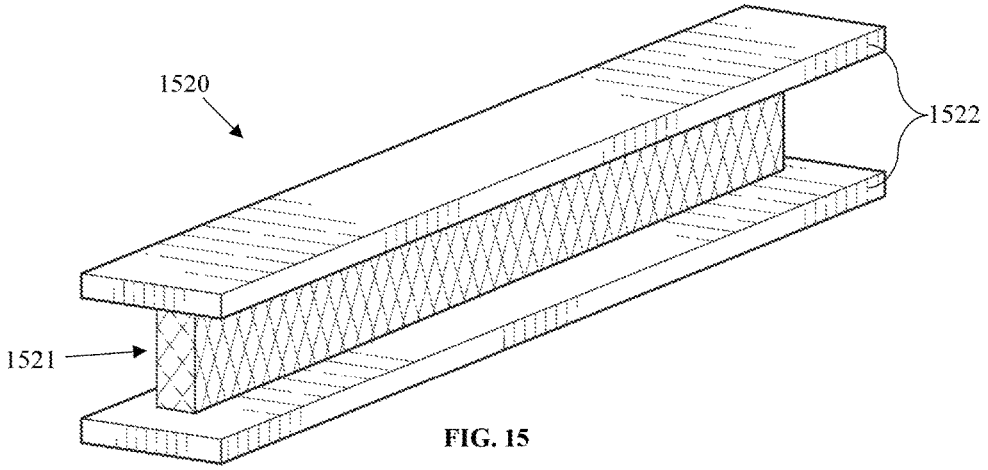
FIG. 15 illustrates a perspective view of an exemplary internal support beam of the header, according to an aspect.

FIG. 15 illustrates a perspective view of an exemplary internal support beam 1520 of the header (1309 and 1409 of FIGS. 13 and 14, respectively), according to an aspect. As an example, the internal support beam 1520 may be a steel I-beam. As an example, a steel I-beam used as a support beam 1520 may be a solid steel I-beam or, as shown by FIG. 15, or an I-beam with a lattice structure 1521. The lattice structure may provide additional structural support, for example.

As shown in FIG. 15, the I-beam may have two plates 1522 connected by a lattice structure 1521. As an example, steel or iron rods intersecting at 45 degree angles may be used to construct the lattice structure 1521. The lattice structure 1521 may be connected to the plates 1522 with welding, for example, or any other suitable association.

It may be advantageous to use a lattice structure instead of solid steel to provide the plastic resin more surface area to attach to during the manufacturing process, and thus allow the plastic resin to more securely attach to the internal beam 1520.

FIG. 16 illustrates a rear elevation view of another exemplary prefabricated building block assembly 1611, according to an aspect. As mentioned hereinbefore, prefabricated building blocks may be assembled in various appropriate arrangements. One possible arrangement, shown by FIGS. 6 though 10, is a vertical arrangement wherein each building block is stacked directly on top of one another. FIG. 16 shows an alternate arrangement wherein building blocks are stacked in a staggered manner, similar to how bricks may be stacked during bricklaying, as known in the art. The seams or joints 1602 and 1603 may be staggered from each other and thus not directly next to or above or below another seam or joint, for example. The staggered arrangement shown by FIG. 16 may be advantageous as it may provide additional stability to a structure by spreading out the placement of the joints and seams of the building blocks. As shown as an example by the assembly 1611, the building blocks used may all be the same type of block having similar mortises and tenons; or, as another example, different types of building blocks may be used to create an assembly of blocks.

As disclosed when referring to FIG. 1, prefabricated building blocks may be used to construct a variety of custom and standard walls. The different exemplary building blocks disclosed hereinbefore may be used to construct a wall in the following exemplary ways. As shown in FIG. 9, the bottom building block 900*b*' may be used to construct the bottom of a wall. The bottom plate 906 may be used to anchor the bottom building block 900*b*', and thus the constructed wall to the foundation. As an example, the bottom plate may be anchored to the foundation with screws or any other suitable anchoring means. The wall building block 100*a* disclosed when referring to FIGS. 1-8, and 16 may be used to construct the center section (i.e., the middle rows of a wall) of a wall. As shown in FIG. 10, the top building block 1000*c*' may be used to construct the top of a wall. Thus, the top plate 1007 may be used to construct the ceiling and, in the case of a two-story building, and the subfloor may be attached to the top plate. A corner building block (such as 1100*d* and 1200*d*) with a bottom plate (such as 906) may be secured to the foundation and used to construct the bottom level of a wall. Similarly, a corner building block (such as 1100*d* and 1200*d*) with a top plate (such as 1007) may be used to construct the ceiling level of a wall. Additionally, a corner building block (1100*d* or 1200*d*) without a top plate 1007 or a bottom plate 906 may be used to construct the center section of a wall. A header building block 1300*e* may be used to frame an opening, such as for a doorway, window, ceiling, staircase, and so on.

The following exemplary method may be used to construct the frame and sheathing of an 8-foot exterior wall with the prefabricated building blocks disclosed hereinbefore. First, a prefabricated corner building block (such as 1100*d* of FIG. 11) with a bottom plate may be secured to the foundation where to corner of the wall is intended to be. Next, a builder can place a bottom building block 900*b* next to the corner building block and hammer the horizontal tenon of the bottom building block 900*b* into the horizontal mortise of the corner building block. Once the bottom building block is set at the correct location, it can be secured to the foundation. Next, a builder can continue this process until the entire bottom row of the wall has been secured to the foundation.

Once the bottom layer of the wall is assembled and secured to the foundation, the middle section of the wall can be constructed. Wall building blocks (such as 1600*a*) can be stacked on top of the bottom building blocks 900*b* by aligning the dowel protrusions and cutouts and hammering the wall building blocks into place. A building can continue to stack and assemble wall building blocks in this manner until there are 14 rows of wall building blocks. It should be noted that the wall building blocks can be assembled in a vertical, staggered, or another appropriate configuration.

Lastly, after the middle section of wall building blocks is assembled, the ceiling layer of the wall can be constructed.

This may be done by stacking top building blocks (such as 1000*c*) on top of the 14$^{th}$ row of wall building blocks in the same manner used to stack the wall building blocks.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A building block for a modular system for construction of a wall frame, the building block comprising:

a frame portion having:

a rear exterior side;

a front interior side;

a top end;

a bottom end;

a left side; and a right side;

a sheathing portion extending across the rear exterior side;

at least a first stud extending horizontally outwards from the frame portion on the front interior side, such that the first stud and the front interior side are perpendicular;

at least a first dowel protrusion or at least a first dowel cutout on the first stud on the top end;

at least a first mortise having a first mortise depth; and at least a first tenon opposite to the first mortise, the first tenon having a first tenon length, wherein the first mortise depth is equal to the first tenon length;

wherein the top end and the bottom end are substantially flat and parallel to each other;

wherein the front interior side and the rear exterior are substantially flat and parallel to each other;

such that the first mortise is capable of receiving a corresponding first tenon of a corresponding second building block to create a first mortise and tenon joint;

such that the first tenon is capable of being received into a corresponding first mortise of a third building block to create a second mortise and tenon joint;

such that the building block is flush with the second building block; and such that a first interior space is formed within the wall frame between the first stud and the front interior side.

2. The building block of claim 1, wherein the building block is constructed from plastic.

3. The building block of claim 1, further comprising a top plate at the top end, and extending horizontally from the front interior side, and over the first stud.

4. The building block of claim 1, further comprising a bottom plate at the bottom end, and extending horizontally from the front interior side, and under the first stud.

5. The building block of claim 1, further comprising:

an angled corner within the frame portion; and a corner post at the angled corner, and on the front interior side.

6. The building block of claim 1, further comprising:

a second mortise; and a second tenon opposite to the second mortise;

wherein the first mortise extends horizontally across a length of the frame portion; and wherein the second mortise extends vertically across a height of the frame portion;

such that the second mortise is capable of associating with a corresponding second tenon of a fourth building block; and such that the second tenon is capable of associating with a corresponding second mortise of a fifth building block.

7. The building block of claim 1, further comprising a header on the front interior side.

8. The building block of claim 7, further comprising an internal support beam within the header.

9. A building block for a modular system for construction of a wall frame, the building block comprising:

a frame portion having:

a rear exterior side;

a front interior side;

a top end;

a bottom end;

a left side; and a right side;

a sheathing portion extending across the rear exterior side;

a first mortise formed on the left side and extending between the top end and the bottom end, the first mortise having a first mortise depth;

a first tenon extending horizontally from the right side, the first tenon having a first tenon length, and being opposite to the first mortise, such that the first tenon and the right side are perpendicular, and wherein the first mortise depth and the first tenon length are equal;

a second mortise formed on the bottom end and extending between the first mortise and the right side, the second mortise having a second mortise depth;

a second tenon extending vertically from the top end, the second tenon having a second tenon length, and being opposite to the second mortise, and extending between the first mortise and the right side, such that the second tenon and the top end are perpendicular, and wherein the second mortise depth and the second tenon length are equal;

a first stud extending horizontally from the front interior side on the left side such that a right angle is formed on the left side, the first stud having a first stud interior side;

a first dowel protrusion extending vertically from the first stud on the top end, such that the first dowel protrusion and the first stud are perpendicular, and the first dowel protrusion having a first dowel length;

a first dowel cutout on the first stud on the bottom end, the first dowel cutout being opposite to the first dowel protrusion, and having a first dowel depth, wherein the first dowel length is equal to the first dowel depth;

a second stud extending horizontally from the front interior side at a center of the frame portion such that a first distance between the first stud and the second stud is equal to a second distance between the second stud and the right side, and such that the second stud and the front interior side are perpendicular, and the second stud having a second stud interior side;

a second dowel protrusion extending vertically from the second stud end on the top end, such that the second dowel protrusion and the second stud are perpendicular, and the second dowel protrusion having a second dowel length; and a second dowel cutout on the second stud on the bottom end, the second dowel cutout being opposite to the second dowel protrusion, and having a second dowel depth, wherein the second dowel length is equal to the second dowel depth;

such that the wall frame is constructed by the building block forming a plurality of connections with a plurality of corresponding building blocks;

wherein the first stud interior side and the second stud interior side are aligned;

such that a plurality of interior spaces is formed within the wall frame, the plurality of interior spaces comprising:

a first interior space formed between the first stud, the second stud and the front interior side; and a second interior space formed between the second stud and the front interior side.

10. The building block of claim 9, wherein the building block is constructed from plastic.

11. The building block of claim 9, further comprising a top plate at the top end, and extending horizontally from the front interior side, and over the a first stud.

12. The building block of claim 9, further comprising a bottom plate at the bottom end, and extending horizontally from the front interior side, and under the first stud.

13. The building block of claim 9, further comprising:

an angled corner within the frame portion; and a corner post at the angled corner, and on the front interior side.

14. A modular system for construction of a wall frame using building blocks, the wall frame comprising a top wall frame end and a bottom wall frame end, the modular system comprising:

a first building block having:

a first frame portion having:

a first rear exterior side;

a first front interior side;

a first top end;

a first bottom end;

a first left side; and a first right side;

a first sheathing portion extending across the first rear exterior side;

a first stud extending horizontally from the first front interior side on the first left side such that a right angle is formed on the first left side, the first stud having a first stud interior side;

a second stud extending horizontally from the front interior side at a center of the frame portion such that a first distance between the first stud and the second stud is equal to a second distance between the second stud and the right side, and such that the second stud and the front interior side are perpendicular, and the second stud having a second stud interior side;

a first mortise formed on the first left side and extending between the first top end and the first bottom end, the first mortise having a first mortise depth;

a first tenon extending horizontally from the first right side, the first tenon having a first tenon length and being opposite to the first mortise, such that the first tenon and the first right side are perpendicular, wherein the first mortise depth and the first tenon length are equal;

a second mortise formed on the first bottom end and extending between the first mortise and the first right side, the second mortise having a second mortise depth;

a second tenon extending vertically from the first top end, the second tenon having a second tenon length, and being opposite to the second mortise, and extending between the first mortise and the first right side, such that the second tenon and the first top end are perpendicular, and wherein the second mortise depth and the second tenon length are equal;

a second building block having:

a second frame portion having:

a second rear exterior side;

a second front interior side;

a second top end;

a second bottom end;

a second left side; and a second right side;

a second sheathing portion extending across the second rear exterior side;

a third mortise formed on the second left side and extending between the second top end and the second bottom end, the third mortise having a third mortise depth;

a third tenon extending horizontally from the first right side, the third tenon having a third tenon length and being opposite to the third mortise, such that the third tenon and the second right side are perpendicular, wherein the third mortise depth and the third tenon length are equal;

a fourth mortise formed on the second bottom end and extending between the third mortise and the second right side, the fourth mortise having a fourth mortise depth;

a fourth tenon extending vertically from the second top end, the fourth tenon having a fourth tenon length, and being opposite to the fourth mortise, and extending between the third mortise and the second right side, such that the fourth tenon and the second top end are perpendicular, and wherein the fourth mortise depth and the fourth tenon length are equal;

a third building block having:

a third frame portion having:

a third rear exterior side;

a third front interior side;

a third top end;

a third bottom end;

a third left side; and a third right side;

a third sheathing portion extending across the third rear exterior side;

a fifth mortise formed on the third left side and extending between the third top end and the third bottom end, the fifth mortise having a fifth mortise depth;

a fifth tenon extending horizontally from the third right side, the fifth tenon having a fifth tenon length and being opposite to the fifth mortise, such that the fifth tenon and the third right side are perpendicular, wherein the fifth mortise depth and the fifth tenon length are equal;

a sixth mortise formed on the third bottom end and extending between the fifth mortise and the third right side, the sixth mortise having a sixth mortise depth;

a sixth tenon extending vertically from the third top end, the sixth tenon having a sixth tenon length, and being opposite to the sixth mortise, and extending between the sixth mortise and the third right side, such that the sixth tenon and the third top end are perpendicular, and wherein the sixth mortise depth and the sixth tenon length are equal;

such that the wall frame is constructed by the first building block, the second building block, and the third building block forming a plurality of connections;

wherein the plurality of connections is created by the third mortise being received by the first tenon, and a right half of the second tenon and a left half of the fourth tenon being received by sixth mortise;

wherein the fifth stud is vertically aligned with the second stud;

wherein the sixth stud is vertically aligned with the third stud;

wherein the third building block is vertically aligned with a right half of the first building block and a left half of the second building block;

wherein first right side is flush with the second left side; and wherein the first stud interior side and the second stud interior side are aligned;

such that a plurality of interior spaces is formed within the wall frame, the plurality of interior spaces comprising:

a first interior space formed between the first stud, the second stud aligned with the fifth stud, and the first front interior side;

a second interior space formed between the second stud aligned with the fifth stud, the third stud aligned with the sixth stud, and the first front interior side aligned with the third front interior side; and a third interior space formed between the third stud aligned with the sixth stud, the second front interior side aligned with the third front interior side, and the fourth stud.

15. The modular system of claim 14, the first building block further comprising a first dowel protrusion extending vertically from the first stud on the first top end, such that the first dowel protrusion and the first stud are perpendicular, and the first dowel protrusion having a first dowel length;

and a first dowel cutout on the first stud on the first bottom end, the first dowel cutout being opposite to the first dowel protrusion, and having a first dowel depth, wherein the first dowel length is equal to the first dowel depth;

a second dowel protrusion extending vertically from the second stud on the first top end, such that the second dowel protrusion and the second stud are perpendicular, and the second dowel protrusion having a second dowel length; and a second dowel cutout on the second stud on the second bottom end, the second dowel cutout being opposite to the second dowel protrusion, and having a second dowel depth, wherein the second dowel length is equal to the second dowel depth.

16. The modular system of claim 15, wherein the second building block further comprises a top plate at the second top end, and extending horizontally from the second front interior side, and over the second stud.

17. The modular system of claim 14, wherein the first building block the second building block, and the third building block are constructed from plastic.

* * * * *